United States Patent [19]

Slattery

[11] Patent Number: 4,794,874

[45] Date of Patent: Jan. 3, 1989

[54] METHOD OF FORMING TUFTED PILE FABRIC

[75] Inventor: Ian Slattery, Hixson, Tenn.

[73] Assignee: Spencer Wright Industries, Inc., Dalton, Ga.

[21] Appl. No.: 140,480

[22] Filed: Jan. 4, 1988

[51] Int. Cl.[4] ..... D05C 15/00; D05C 15/20

[52] U.S. Cl. ..... 112/266.2; 112/80.43

[58] Field of Search ..... 112/266.2, 80.41, 80.44, 112/80.43, 221, 80.31

[56] References Cited

U.S. PATENT DOCUMENTS

| | | | |
|---|---|---|---|
| 3,016,029 | 1/1962 | Card | 112/80.43 |
| 3,259,088 | 7/1966 | Rockholt | 112/80.43 |
| 3,547,058 | 12/1970 | Brown et al. | 112/80.43 |
| 3,881,432 | 5/1975 | Dodd et al. | 112/80.43 |
| 3,978,800 | 9/1976 | Card | 112/80.43 |

*Primary Examiner*—Ronald Feldbaum

*Attorney, Agent, or Firm*—Alan Ruderman

[57] ABSTRACT

An individually controlled needle tufting machine having loopers with beaks pointing in the same direction as the backing material being fed through the machine so as to form loop pile has means for laterally shifting the backing material continuously first in one direction and then in the other. The method is disclosed utilizing this apparatus for forming zig-zag backstitches with selective needles by stitching during each cycle of the machine, while in other selective needles linear backstitches are formed by driving those needles during alternate cycles. Fabrics are produced utilizing this method wherein the loop density produced can be selectively chosen for various portions of the fabric so as to provide patterning effects. By foregoing the shifting of the backing material similar, but less pronounced patterning effects may be attained.

10 Claims, 2 Drawing Sheets

METHOD OF FORMING TUFTED PILE FABRIC

BACKGROUND OF THE INVENTION

This invention relates to the art of tufting and more particularly to a method of forming a loop pile fabric having variations in pile density over selective portions of the fabric, the method utilizing a controlled needle tufting machine.

Controlled needle tufting machines are known in the art for selectively engaging and disengaging, in skip-stitch fashion, various of the needles in accordance with a program during each reciprocatory cycle of the needle driving push rods. Basically these machines render selective needles or groups of needles inoperative while the remainder of the needles are operative to pierce and penetrate the backing fabric upon each stroke of the push rods. Examples of such machines are illustrated in U.S. Pat. Nos. 3,115,856; 3,259,088; 3,881,432 and 3,986,465. Such machines, which have been very successful, especially for producing bed spreads, and in the case of individually controlled needle tufting machines have been widely accepted for overtufting a design into a pretufted fabric, as described in U.S. Pat. No. 4,693,190, have only been used to form cut pile fabric wherein the loops formed by the operative needles are cut by respective knives acting beneath the bed of the machine in conjunction with the loop seizing hook. There are two basic reasons for this. The first is because if loop pile were being formed the backstitch normally would be excessively long after an operative needle was subsequently rendered inoperative for a number of subsequent cycles and then rendered operative again. The second is because the previously formed loops would be pulled from the fabric when the needle is rendered inoperative.

For example, in conventional tufting machines the yarn sewn by a particular needle is continuous in that the backstitches are connected together between successive penetrations of the needle into the backing. This is true whether forming loop pile or cut pile, the difference being that in cut pile the loops are cut by the knife acting in conjunction with the loop seizing hook, and this cutting occurs substantially at the center of a loop, and generally there are approximately four such loops on a hook and the cutting for each cycle occurs in regard to the first such loop. Thus, the strand of yarn from the last loop extends back through the needle eye to the yarn feeding means. In a controlled needle tufting machine, however, when a particular needle is held inoperative, the backstitch, unless cut, would extend from the last penetration of the needle while operative to the subsequent penetration which may not occur for a substantial number of cycles. This not only is a waste of yarn but also could result in interlocking of the yarn from a nonoperative needle with the yarn from an adjacent operative needle when it penetrates the backing. Additionally, since only those needles which are stitching are consuming yarn, the amount of yarn on the backstitch side of the backing would be excessive, whether the machine were of the cut pile or loop pile type. For this reason a special yarn clamping device is used which grips and pulls yarn directly from the creel or other yarn storage device on the downstroke of an operative needle, but slips over the yarn on the upstroke and is ineffective when the needle is inoperative.

When forming cut pile on a controlled needle machine when a loop of yarn is cut on the last stitch formed by an operative needle which is thereafter rendered inoperative for a number of cycles, the strand of yarn which remains extending through the needle eye while the needle is inoperative is unattached to any other tufts previously formed. The initial loop thereafter formed when the needle is again rendered operative is not locked into the backing, and is subsequently extracted by a "tail picker" subsequent to the cutting of the loop. Thus, for cut pile fabric the amount of yarn on the backstitch side of the backing material is minimized. If using such a clamp for a loop pile needle which is inoperative for a number of cycles, when the needle is again operatively engaged the yarn not only would be pulled from the creel, but would also be pulled from the last loops since the yarn would extend from the loop back through the needle eye to the creel. Consequently, the pile height of the last few loops formed would be reduced, and this reduction would probably occur nonproportionally in the few loops. Accordingly, such machines have not been utilized to form loop pile fabrics.

The tufting industry has progressively evolved through innovations directed toward duplicating, or at least simulating products which previously were only produced by weaving on a loom. As such products have evolved, because of the substantially higher production rates of the tufting process relative to weaving, more universal availability of the products has resulted. There are, however, certain types of patterns which are currently produced by looms that have not been simulated by tufting. The controlled needle machine, especially the individually controlled needle machines wherein each needle can be selectively controlled to stitch or not stitch, offers the potential of producing a type of product not now produced except by looms. One such product is a carpet having a density variation in various selective portions of the fabric. It is doubtful whether if produced by a controlled needle tufting machine such density variation would be effective visibly if produced utilizing cut pile, but a loop pile product would provide the desired look.

SUMMARY OF THE INVENTION

Consequently, it is a primary object of the present invention to provide a method of tufting a loop pile fabric with varying pile density at selective locations in accordance with a pattern.

It is another object of the present invention to provide a method of forming loop pile tufted fabric using a tufting machine wherein selected needles stitch at least periodically every cycle of the machine and other needles stitch during only selective cycles, the fabric being continuously shifted laterally relative to the direction of feed through the machine.

It is further object of the present invention to provide a method of tufting a loop pile fabric using a controlled needle tufting machine including shifting means for laterally moving the backing material relatively to the needles, and wherein certain selected needles stitch during every cycle while other needles stitch during alternate cycles.

It is a still further object of the present invention to provide a method of tufting a loop pile fabric, the method including shifting the fabric backing material continuously back and forth laterally relatively to the needles and to the direction in which the backing is being fed through the machine, and forming loops by selective first needles during each machine cycle and forming loops by selective second needles during alternate machine cycles so that a zig-zag backstitch pattern is formed by the first needles while a substantially straight backstitch is formed by the second needles, the density of the pile formed on the face of the backing by the second needles being half that of the density formed by the first needles.

Accordingly, the present invention provides a method of tufting using a controlled needle tufting machine with loopers having respective beaks pointing in the same direction as the backing material is being fed through the machine so as to form loop pile, means for laterally shifting the backing, and patterning means for selecting a first array of needles to be driven into loop seizing relationship with cooperating loopers during each cycle of the machine to form zig-zag backstitches, and a second array of needles to be driven into loop seizing relationship with cooperating loopers during only certain cycles of the machine to form straight or substantially aligned backstitches. Preferably, the second array of needles forms loops during alternate cycles of the machine so that the pile formed by the second array of needles is half the density of the pile formed by the first array of needles.

Furthermore, although the patterns would not be as pronounced or defined, the method may forego shifting of the backing material laterally. In this instance the first array of needles would form straight backstitches during every cycle and the second array of needles would also form straight backstitches but only during alternate cycles. Thus, density variations would occur, but these variations would not be as defined as when the backing material is shifted laterally.

The patterning means may provide that one or more needles in the first array will be in the second array during selective time so that fabric may be produced wherein a single needle may selectively provide yarn loops spaced apart differently during the process, and thus unique designs.

It is preferred that the controlled needle machine have individually controlled needles so as to provide maximum flexibility to the patterning capability of the machine. The means for shifting the backing material relatively to the needles preferably comprises backing material or fabric shifting means rather than a sliding needle bar, such means being sliding needle bar apparatus or a "jute" shifter.

A fabric constructed by the method of this invention may have various portions thereof comprising closely spaced loops during portions of the fabric and wider spaced loops in other portions thereof so that various patterning effects result. For example, the fabric may have "boxes" in certain areas which are of higher density than adjacent areas, and these boxes may provide a checkerboard-type of array, or a first density box may be within a central portion of a larger box having a different density, or a number of such boxes may be circumscribed about others with the densities varying between adjacent boxes. Additionally, because of the unique flexibility of patterning provided by the controlled needle machine, rather than boxes, circles or other geometric patterns may be produced within other areas of the fabric and having different densities therefrom.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
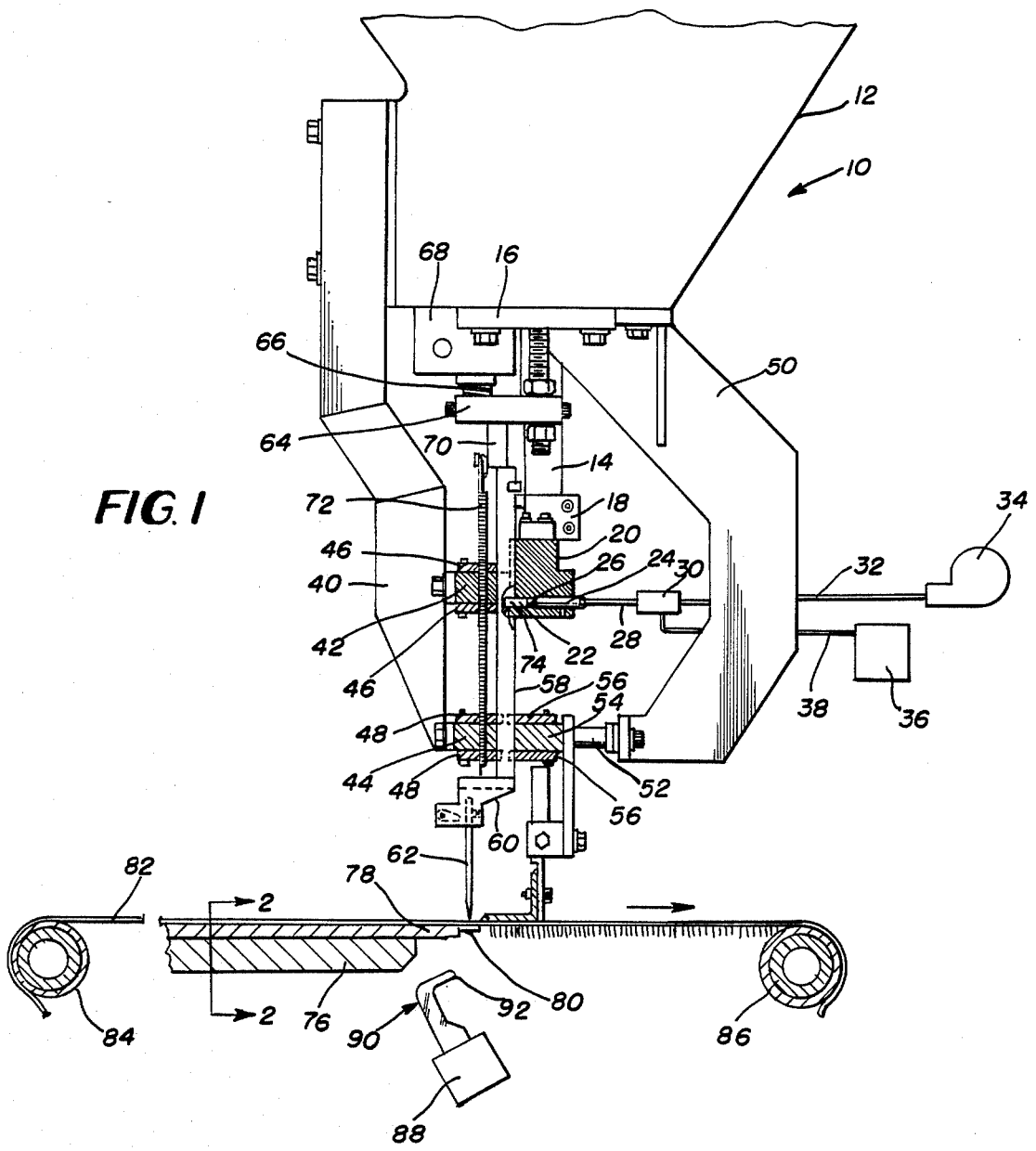
FIG. 1 is a fragmentary vertical cross sectional view taken substantially through a tufting machine incorporating structural features for performing the method of the present invention.
Figure 2:
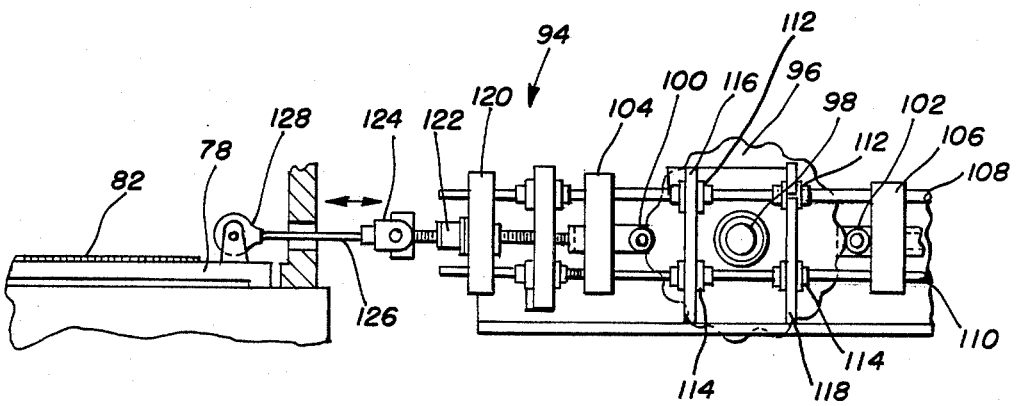
FIG. 2 is a fragmentary cross sectional view taken substantially along line 2—2 of, FIG. 1.

Referring to FIG. 1 of the drawing, there is illustrated a tufting machine 10 embodying the preferred mode of carrying out the invention, the machine having a head 12 within which is mounted conventional drive mechanism for reciprocably driving a plurality of push rods 14, only one of which is shown, journalled for reciprocation in sleeve mounted in a support plate 16 at the bottom of the head. At the lower end of each push rod is a push rod foot 18 having secured to the bottom end thereof an air cylinder bar 20, the air cylinder bar preferably extending tranvsersely across the length of the machine and supported by each of the push rod feet. Extending through the air cylinder bar is a multiplicity of bores 22 which are preferably staggered transversely so that one bore corresponds to each needle in the machine for an individually controlled needle tufting machine. The push rods together with air cylinder bar reciprocate vertically during each cycle of the machine as is well known in the art.

Mounted within each bore 22 is a respective air cylinder 24 having a respective latch pin 26 The air cylinder 24 communicates through conduits 28 with a respective electrically controlled pneumatic valve 30 which further communicate through conduits 32 with a single source of pressurized air such as a compressor 34. The valves 30 are electrically controlled by a pattern control 36 through electrical leads or the like 38, the pattern control 36 preferably being a computer driven control system loaded with pattern information from, for example, a floppy disc or the like prepared on a separate pattern generation system. Consequently, as determined by the pattern control 36 the valve 30 may permit air to flow from the compressor to the cylinder 34 to extend the latch pin 26, or vent the valve. The pin is biased to the retracted position so that when pressurized air is not supplied to the cylinder 24 the pin is not extended.

Attached to the head 12 of the machine is a plurality of guide bar support brackets 40 which carries a pair of vertically spaced guide bars 42, 44 each of which is sandwiched between a pair of guide plates 46, 48. At the rear of the machine a support bracket 50 is carried by the head 12 of the machine and at its lower end carries a spacer member 52 which is secured to a rear guide bar 54 sandwiched between a pair of guide plates 56.

Mounted between the guide plates 46, 48 and 56 and guided thereby is a multiplicity of needle holders 58, there being one needle holder for each needle in the machine. A needle bar 60 is carried at the bottom of each needle holder 58, each needle bar 60 carrying a respective needle 62. An adjustable stop bar 64 is supported by a lead screw 66 carried by a jack screw device 68 in a manner similar to and for purposes as described in the aforesaid U.S. Pat. No. 3,881,432. Extending downwardly from the stop bar 64 is an abutment member 70 to which the upper end of a multiplicity of springs 72 are attached, there being one spring for each needle holder, and the lower end of each spring is connected to the respective needle bar 60. The springs 72 act normally urge the needle holders 58 upwardly against the bottom of the abutment member 70. Each needle holder 58 includes a recess 74 for receiving the air cylinder pin 26 when extended, and when a selected needle is to be driven the pin 26 enters the recess 74 and drives the needle holder downwardly.

Mounted on a bed plate 76 in the bed of the machine beneath the head 12 is needle plate 78 which carries the needle plate fingers 80, the needle plate 78 and fingers 80 supporting a backing material 82 fed from feed rollers 84 over the bed and wound onto take-off rollers 86, only one roll being illustrated in regard to the feed rollers and the take-off rollers.

Below the head 12 in the bed of the machine and driven in an oscillatory manner in timed relationship with the push rods 14 is a looper bar 88 which carries a multiplicity of loop pile loopers 90, there being one looper for each needle 62. The loopers, according to the present invention, are of the loop pile type wherein the loop entering and seizing bill 92 points in the direction in which the backing material 82 is fed through the machine. The looper 90 acts in conventional manner to seize and thereafter shed a loop from a corresponding needle 62 when that needle is driven through the action of the cylinder pin 26 acting in conjunction with the needle holder 58. Loopers which correspond to needles which are not driven merely oscillate without seizing a loop.

In accordance with the present invention the backing material 82 is shifted laterally or transversely relatively to the direction in which the fabric 82 is being fed by the rollers 84, 86 through the machine. Although any conventional means for laterally shifting the backing relatively to the needles may be utilized, for purposes of disclosure a sliding needle plate drive apparatus 94 is illustrated. The apparatus 94 comprises a cam 96 rotatably driven on a shaft 98 in timed relationship with the reciprocation of the push rods 14. The cam 96 acts in conjunction with a pair of followers 100, 102 supported by respective brackets 104, 106 secured to guide rods 108, 110 slidably journalled in respective linear bearings 112, 114 carried by brackets 116, 118. As the cam 96 rotates its motion is transmitted through the followers to the brackets 104, 106, and from these brackets to the guide rods 108, 110. A clamping block 120 is secured to the guide rods 108, 110 and has a collar or the like 22 connected thereto, the collar being attached in adjustable fashion to a connecting member 124 which transfers the linear motion of the guide bars 108, 110 to one end of a connecting rod 126 having its other end fastened to a connecting member 122 journally attached to the needle plate 78.

Preferably the cam 96 is of the type which shifts the needle plate 78 one step or needle gauge in a first direction during one cycle of the push rod 14, and in the opposite direction during the subsequent cycle of the push rod 14, the shifting occurring while the push rods are in the raised position and the needles both latched and unlatched are outside of the backing material 82. Accordingly, with such a cam any needle which is latched during at least two cycles of the push rod will penetrate the backing material in laterally spaced locations, and on the next cycle, if latched, will penetrate the backing material at the same lateral location as the first penetration, albeit downstream relative to the direction in which the fabric moves. Thus, a needle so latched will form a zig-zag stitch pattern on the backstitch surface of the backing material as the respective looper 90 seizes a loop from the needle 62.

Figure 3:
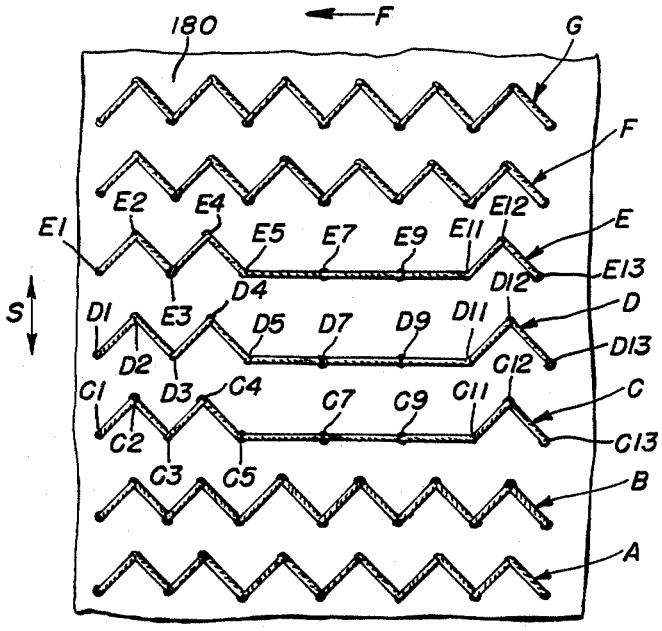
FIG. 3 depicts a portion of a tufted fabric produced by the method of the present invention, the backstitch for seven needles during 13 cycles of the machine being illustrated.

Referring to FIG. 3, with the direction the material is fed through the machine by the rollers 84, 86 being illustrated by the arrow designated F and the direction of shifting of the material by the apparatus 94 being illustrated by the double arrow designated S, a portion of the backstitch surface of a fabric 180 produced by a seven needle section of the machine is depicted. The backstitchs formed by the seven respective needles are designated A, B, C, D, E, F and G. The needles which produce stitches A, B, F and G while the material illustrated is formed, are each latched during each of the 13 cycles illustrated, and since the backing is shifting laterally first in one direction and then in the other, each of the backstitches formed are in a zig-zag pattern. Of course, loop pile loops extend from each of the 13 penetration points of the respective needles. In regard to backstitches C, D and E, during the first five cycles the respective needles are latched so as to form loops at the penetration points C1–C5, D1–D5 and E1–E5. However, during the next cycle each of the needles forming the stitches is unlatched while the backing is shifted or jogged one step. These needles thereafter in the subsequent cycle are latched so as to pierce the backing at C7, D7 and E7 respectively. As illustrated, during cycles 8 and 10 these needles are unlatched, but during cycles 9, 11, 12 and 13 the needles are latched. Thus, a zig-zag backstitch is formed by each needle from cycle 11 through cycle 13, but between cycles 5 and 11 the backstitches are substantially straight or aligned. However, since there is no penetration made by the needles creating backstitches C, D and E during cycle 6, 8 and 10, there are no loops formed. Consequently the spacing between loops formed during penetration in cycles 5 and 7, 7 and 9, and 9 and 11 is twice that formed by the other four needles, i.e., the pile density created by the three needles is one-half that of the other needles. This density variation gives the impression that the backing is being fed through the machine at twice the speed in regard to the three needles during cycles 5 through 11.

Although the pattern controller 36 may be programmed to unlatch each needle for more than one cycle at a time, the backstitch created by unlatching the three needles, i.e., those forming stitches C, D and E, would be longer than desired. If unlatched for two cycles while shifting the fabric one step during a first cycle and then one step back during the next cycle, the penetration or piercing points would be offset from the prior penetrations by one step and the backstitch would be a longer zig-zag form. Thus, an odd number of skips is desirable but three skips would provide an excessively long backstitch since the penetration points of that needle would be spaced apart by a backstitch equivalent to four cycles. Therefore, it is believed that skipping on alternate cycles would provide the desired affects without producing the problems heretofore described regarding use of controlled needle machines for producing loop pile.

Figure 4:
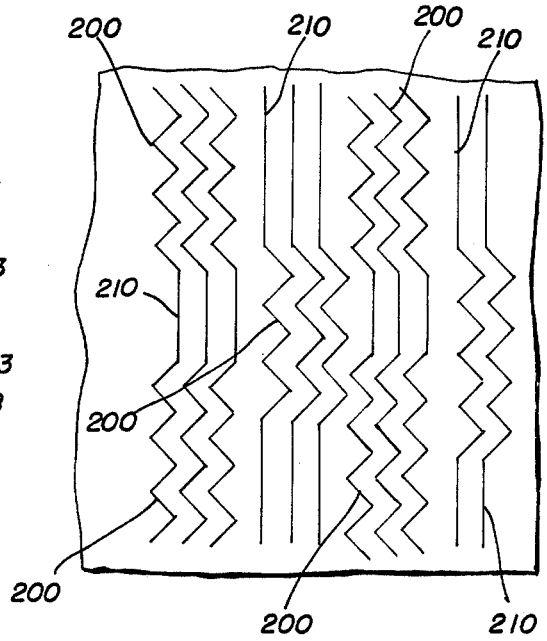
FIG. 4 depicts one form of backstitch pattern capable of being produced by the method of the present invention.
Figure 5:
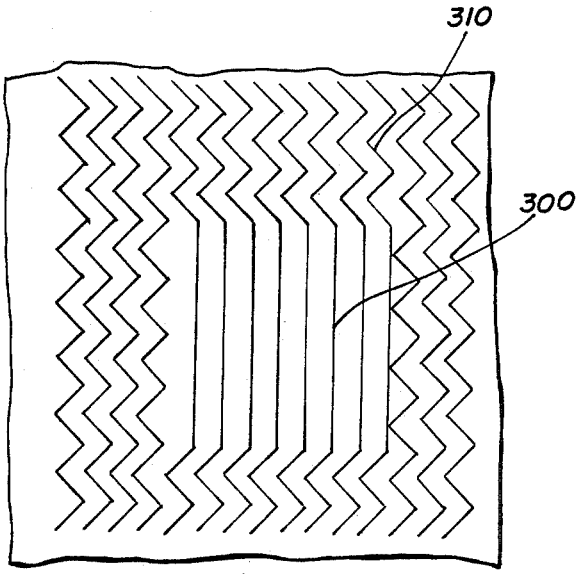
FIG. 5 is a view similar to FIG. 4 but depicting another pattern array.

In FIGS. 4 and 5 two possible patterns are depicted utilizing the afore described method. In FIG. 4 the backstitches of the fabric include alternate areas of high density or a zig-zag array 200 separated by areas of lower density or a straight stitch array 210, thereby to provide a checkerboard pattern on the face of the fabric. In FIG. 5 there is a low density area of a straight stitch array 300 surrounded by a higher density area of a zig-zag array 310. The area 310 may be disposed within a low density area if aesthetically desirable. In any event, these patterns are merely examples that are possible with the method of the present invention, circles and other geometric patterns being additionally producable. It should also be understood that by threading adjacent needles with alternate colors and selectively latching or unlatching various other needles the patterning affects provided by the method of the present invention are greatly expanded.

Although not illustrated, density variations may be obtained by disconnecting the needle plate drive apparatus 94, or other apparatus for laterally shifting the backing material. The density variations would not be as pronounced as when the backing material is shifted, however some desirable patterning effects may be attainable. In this instance a first array of needles would be latched to form a backstitch during two or more successive machine cycles while the second array of needles would be latched and unlatched during alternate cycles. The selected needle arrays would, of course, be varied by the programmer so that various portions of the fabric would selectively have half the yarn density as the remainder of the fabric, and the location of the density variations would be selected in accordance with the desired pattern.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of tufting loop pile fabric by a tufting machine having at least a pair of laterally spaced apart reciprocably mounted needles and a loop seizing looper cooperating with each needle for seizing and thereafter shedding a loop of yarn received from a respective needle, said method comprising:

a feeding a backing material through the tufting in a longitudinal direction transverse to the laterally extending needles, b continuously shifting the backing material laterally relatively to the needles while the needles are outside the backing material, c penetrating the backing material to form a loop by both needles to be seized and shed by the respective looper, and d subsequently penetrating the backing material to form a loop with one of the needles but not the other, which loop is seized and thereafter shed by the respective looper.

2. The method as recited in claim 1, including subsequently penetrating the backing material to form a loop by both needles to be seized and shed by the respective looper.

3. A method of tufting loop pile fabric in a tufting machine having a multiplicity of reciprocably mounted needles spaced apart laterally across said machine and a loop seizing looper cooperating with each needle for seizing and thereafter shedding a loop of yarn received from a respective needle, said method comprising:

a. feeding a backing material through the tufting machine in a longitudinal direction transverse to the laterally extending needles, b. penetrating backing material with selective yarn carrying needles to form an array of yarn loops seized and shed from respective loopers extending from one surface of the backing material, c. shifting the backing material laterally relatively to said needles in a first direction while the needles are outside the backing material, d. again penetrating the backing material with a first series of said selective yarn carrying needles but not with a second series of said selective yarn carrying needles to form an array of yarn loops seized and shed from respective loopers extending from said one surface, e. shifting the backing material laterally relative to said needles in the opposite direction from said first direction while the needles are outside the backing material, and f. thereafter penetrating the backing material again with said selective yarn carrying needles to form another array of loops seized and shed by respective loopers extending from one surface of the backing material, whereby loops extending from said one surface formed by said second series of needles are longitudinally spaced apart further than loops extending from said one surface formed by said first series of needles.

4. The method as recited in claim 3, including subsequently shifting said backing material laterally relatively to said needles in said first direction while the needles are outside the backing material, and thereafter penetrating the backing material with at least certain of said selective needles including at least some of the needles of said second series to form loops of yarn extending from said one surface.

5. The method as recited in claim 3, including subsequently shifting said backing material laterally relatively to said needles in said first direction while the needles are outside the backing material, and thereafter penetrating the backing material with certain of said selective needles excluding at least some of the needles of said first series.

6. A method of tufting loop pile fabric in a tufting machine having a bank of laterally spaced apart needles selectively reciprocably driven into loop seizing relationship with respectively cooperating loopers which seize and thereafter shed respective loops of yarn received from the cooperating needles, said method comprising:

a. feeding a backing material through the tufting machine in a longitudinal direction transverse to the laterally extending needles, continuously shifting the backing material laterally relatively to the needles while the needles are outside the backing material, b. penetrating the backing material during at least three successive cycles of said machine by at least one of said needles to form loops of yarn extending from one surface of said backing material and a zig-zag backstitch on the other surface thereof, and c. penetrating the backing material during only certain non-successive of said cycles by at least a second of said needles to form loops of yarn extending from said one surface and a substantially linear backstitch on the other surface thereof.

7. The method as recited in claim 6, wherein said second needle penetrates said backing material during alternate cycles.

8. The method as recited in claim 7, including penetrating said second needle through said backing material during successive subsequent cycles of said machine.

9. A method of tufting loop pile fabric in a tufting machine having a multiplicity of reciprocably mounted needles spaced apart laterally across said machine and a loop seizing looper cooperating with each needle for seizing and thereafter shedding a loop of yarn received from a respective needle, said method comprising:

a. feeding a backing material continuously through the tufting machine in a longitudinal direction transverse to the laterally extending needles, b. penetrating backing material during a first reciprocating cycle with selective yarn carrying needles to form an array of yarn loops seized and shed from respective loopers extending from one surface of the backing material, c. again penetrating the backing material during the next subsequent reciprocating cycle with a first series of said selective yarn carrying needles but not with a second series of said selective yarn carrying needles to form an array of yarn loops seized and shed from respective loopers extending from said one surface, d. thereafter penetrating the backing material again during the next subsequent reciprocating cycle with all of said selective yarn carrying needles to form another array of loops seized and shed by respective loopers extending from said one surface of the backing material, whereby loops extending from said one surface formed by said second series of needles are longitudinally spaced apart further than loops extending from said one surface formed by said first series of needles.

10. The method as recited in claim 9, wherein said second series of yarn carrying needles penetrate said backing material only on alternate reciprocating cycles.

* * * * *